US009284861B2

(12) United States Patent
Wigsten et al.

(10) Patent No.: US 9,284,861 B2
(45) Date of Patent: Mar. 15, 2016

(54) OIL PASSAGE DESIGN FOR A PHASER OR DUAL PHASER

(75) Inventors: Mark Wigsten, Lansing, NY (US); Michael W Marsh, Dryden, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 192 days.

(21) Appl. No.: 14/237,950

(22) PCT Filed: Aug. 23, 2012

(86) PCT No.: PCT/US2012/052018

§ 371 (c)(1), (2), (4) Date: Feb. 10, 2014

(87) PCT Pub. No.: WO2013/032842

PCT Pub. Date: Mar. 7, 2013

(65) Prior Publication Data

US 2014/0190435 A1 Jul. 10, 2014

Related U.S. Application Data

(60) Provisional application No. 61/528,920, filed on Aug. 30, 2011, provisional application No. 61/547,390, filed on Oct. 14, 2011, provisional application No. 61/667,127, filed on Jul. 2, 2012.

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/344* (2013.01); *F01L 1/3442* (2013.01); *F01L 2001/0473* (2013.01); *F01L 2001/34493* (2013.01); *Y10T 29/49293* (2015.01)

(58) Field of Classification Search

CPC ..... F01L 2001/34496; F01L 2001/34493; F01L 2001/34486; F01L 2001/34479; F01L 2001/34423; F01L 1/3442; F01L 2001/34489

See application file for complete search history.

(56) References Cited

U.S. PATENT DOCUMENTS 5,724,929 A * 3/1998 Mikame ..... F01L 1/3442 123/90.17

6,244,230 B1 6/2001 Mikame (Continued)

FOREIGN PATENT DOCUMENTS

| | | | |
|---|---|---|---|
| JP | 2001289013 | A | 10/2001 |
| JP | 2002235512 | A | 8/2002 |
| WO | 2010033415 | A2 | 3/2010 |

*Primary Examiner* — Jesse Bogue

*Assistant Examiner* — Daniel Bernstein

(74) *Attorney, Agent, or Firm* — Helmholdt Law PLC; Thomas D. Helmholdt

(57) ABSTRACT

A variable cam timing phaser (10) includes a fluid transfer assembly with at least one of a fluid transfer sleeve (72) having a plurality of pressurized fluid passages (74*a*, 74*b*, 74*c*, 74*d*), and a fluid transfer plate (60) having a plurality of pressurized fluid passages (62*a*, 62*b*, 62*c*, 62*d*). Each passage (74*a*, 74*b*, 74*c*, 74*d*) extends in fluid communication with a corresponding circumferentially spaced annular groove segment portion (74*f*, 74*g*, 74*h*, 74*i*) for selective communication with first and second vane-type hydraulic couplings (40, 50) depending on an angular orientation of the fluid transfer sleeve (72) during rotation. Each passage (62*a*, 62*b*, 62*c*, 62*d*) extending from a corresponding centrally located port (64*a*, 64*b*, 64*c*, 64*d*) in fluid communication with a radially extending passage portion (66*a*, 66*b*, 66*c*, 66*d*) and with an arcuately extending passage portion (68*a*, 68*b*, 68*c*, 68*d*).

15 Claims, 8 Drawing Sheets

(56) References Cited

U.S. PATENT DOCUMENTS

| | | | | |
|---|---|---|---|---|
| 6,725,817 | B2 | 4/2004 | Methley et al. | |
| 6,964,249 | B2 | 11/2005 | Komaki | |
| 7,270,096 | B2 | 9/2007 | Lancefield et al. | |
| 7,669,566 | B2 | 3/2010 | Methley | |
| 7,789,054 | B2 * | 9/2010 | Rozario | F01L 1/047 123/90.15 |
| 7,819,099 | B2 | 10/2010 | Lawrence et al. | |
| 7,841,311 | B2 | 11/2010 | Hutcheson et al. | |
| 2010/0050967 | A1 | 3/2010 | Lancefield et al. | |
| 2010/0093453 | A1 | 4/2010 | Myers et al. | |
| 2010/0186698 | A1 | 7/2010 | Pluta | |
| 2011/0107991 | A1 | 5/2011 | Kinouchi et al. | |
| 2012/0152191 | A1 * | 6/2012 | Yoshika | F01L 1/143 123/90.15 |
| 2012/0279464 | A1 * | 11/2012 | Tateno | F01L 1/3442 123/90.15 |
| 2014/0076255 | A1 * | 3/2014 | Brodbeck | F01L 1/047 123/90.17 |
| 2015/0007789 | A1 * | 1/2015 | Matsumochi | F01L 1/047 123/90.17 |

* cited by examiner

OIL PASSAGE DESIGN FOR A PHASER OR DUAL PHASER

CROSS-REFERENCE TO RELATED APPLICATIONS

This application is a continuation-in-part of and under §119(e) claims the benefit of U.S. patent application Ser. No. 61/528,920 filed on Aug. 30, 2011 which is incorporated by reference herein in its entirety, is a continuation-in-part of and under §119(e) claims the benefit of U.S. Provisional Pat. Appl. Ser. No. 61/547,390 filed on Oct. 14, 2011, which is incorporated by reference herein in its entirety, and is a continuation-in-part of and under §119(e) claims the benefit of U.S. patent application Ser. No. 61/667,127 filed on Jul. 2, 2012.

FIELD OF THE INVENTION

The invention relates to a mechanism intermediate a crankshaft and a poppet-type intake or exhaust valve of an internal combustion engine for operating at least one such valve, wherein the mechanism varies the time period relative to the operating cycle of the engine, and more particularly, wherein the mechanism operably engages with a concentric camshaft to vary an angular position of one camshaft and an associated cam relative to another camshaft and associated cam.

BACKGROUND

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. A crankshaft can take power from the pistons to drive at least one transmission and at least one camshaft. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

As is conventional in the art, there can be one or more camshafts per engine. A camshaft can be driven by a belt, or a chain, or one or more gears, or another camshaft. One or more lobes can exist on a camshaft to push on one or more valves. A multiple camshaft engine typically has one camshaft for exhaust valves, one camshaft for intake valves. A "V" type engine usually has two camshafts (one for each bank) or four camshafts (intake and exhaust for each bank).

Variable cam timing (VCT) devices are generally known in the art, such as U.S. Pat. No. 7,841,311; U.S. Pat. No. 7,789,054; U.S. Pat. No. 7,270,096; U.S. Pat. No. 6,725,817; U.S. Pat. No. 6,244,230; and U.S. Published Application No. 2010/0050967. Known patents and publications disclose hydraulic couplings for single phaser assemblies in which an annular space is provided between a drive member concentrically surrounding a single driven member. The annular space is divided into segment-shaped or arcuate variable volume working chambers by one or more vanes extending radially inward from an inner surface of the drive member and one or more vanes extending radially outward from an outer surface of the single driven member. As hydraulic fluid is admitted into and expelled from the various chambers, the vanes rotate relative to one another and thereby vary the relative angular position of the drive member and the single driven member. Hydraulic couplings that use radial vanes to apply a tangentially acting force will be referred to herein as vane-type hydraulic couplings. Each of these prior known patents and publications appears to be suitable for its intended purpose. However, dual variable cam timing (VCT) devices with variable volume working chambers that are positioned axially spaced with respect to one another require additional axial space for the dual VCT assembly, while those dual VCT devices with variable volume working chambers that are positioned circumferentially spaced with respect to one another potentially suffer from reduced angular actuation distance of the associated rotor and vane, and can potentially suffer from reduced actuation force as a result of limited number of vanes, limited vane surface area, and limited actuation fluid chamber size. Therefore, it would be desirable to provide a configuration that requires less axial space for a dual VCT assembly. It would also be desirable to provide increased angular actuation distances for a dual VCT assembly. Further, it would be desirable to provide increased actuation force capabilities for a dual VCT assembly.

SUMMARY

A dual variable cam timing phaser can be driven by power transferred from an engine crankshaft and delivered to a concentric camshaft having a radially inner shaft and a radially outer shaft for manipulating two sets of cams. The phaser can include a drive stator connectible for rotation with an engine crankshaft and two concentric driven rotors, each rotor connectible for rotation with a respective one shaft of the concentric camshaft supporting the corresponding two sets of cams. The drive stator and the driven rotors are all mounted for rotation about a common axis. The driven rotors are coupled for rotation with the drive stator by a plurality of radially stacked, (as opposed to axially stacked or circumferentially stacked), vane-type hydraulic couplings to enable the phase of the driven rotors to be adjusted independently of one another relative to the drive stator. It should be recognized that this configuration requires less axial space for a dual VCT assembly. Furthermore, this configuration can provide increased angular actuation distances for a dual VCT assembly. This configuration can also provide increased actuation force capabilities for a dual VCT assembly.

A dual variable cam timing phaser for an internal combustion engine having a concentric camshaft with a radially inner shaft and a radially outer shaft can include a stator having an axis of rotation. An outer rotor can be rotatable relative to the axis of rotation of the stator independently of the stator. A radially outer located vane-type hydraulic coupling can include a combination of an outer vane and cavity associated with the outer rotor to define first and second outer variable volume working chambers. An inner rotor can be rotatable relative to the axis of rotation of the stator independently of both the stator and the outer rotor. The inner rotor can be located radially inwardly within an innermost periphery of the outer rotor. A radially inner located vane-type hydraulic coupling can include a combination of an inner vane and cavity associated with the inner rotor to define first and second inner variable volume working chambers. A plurality of fluid passages can connect the first and second, outer and inner working chambers with respect to a source of pressurized fluid for facilitating angular phase orientation of the outer and inner rotors independently with respect to each other and independently with respect to the stator.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
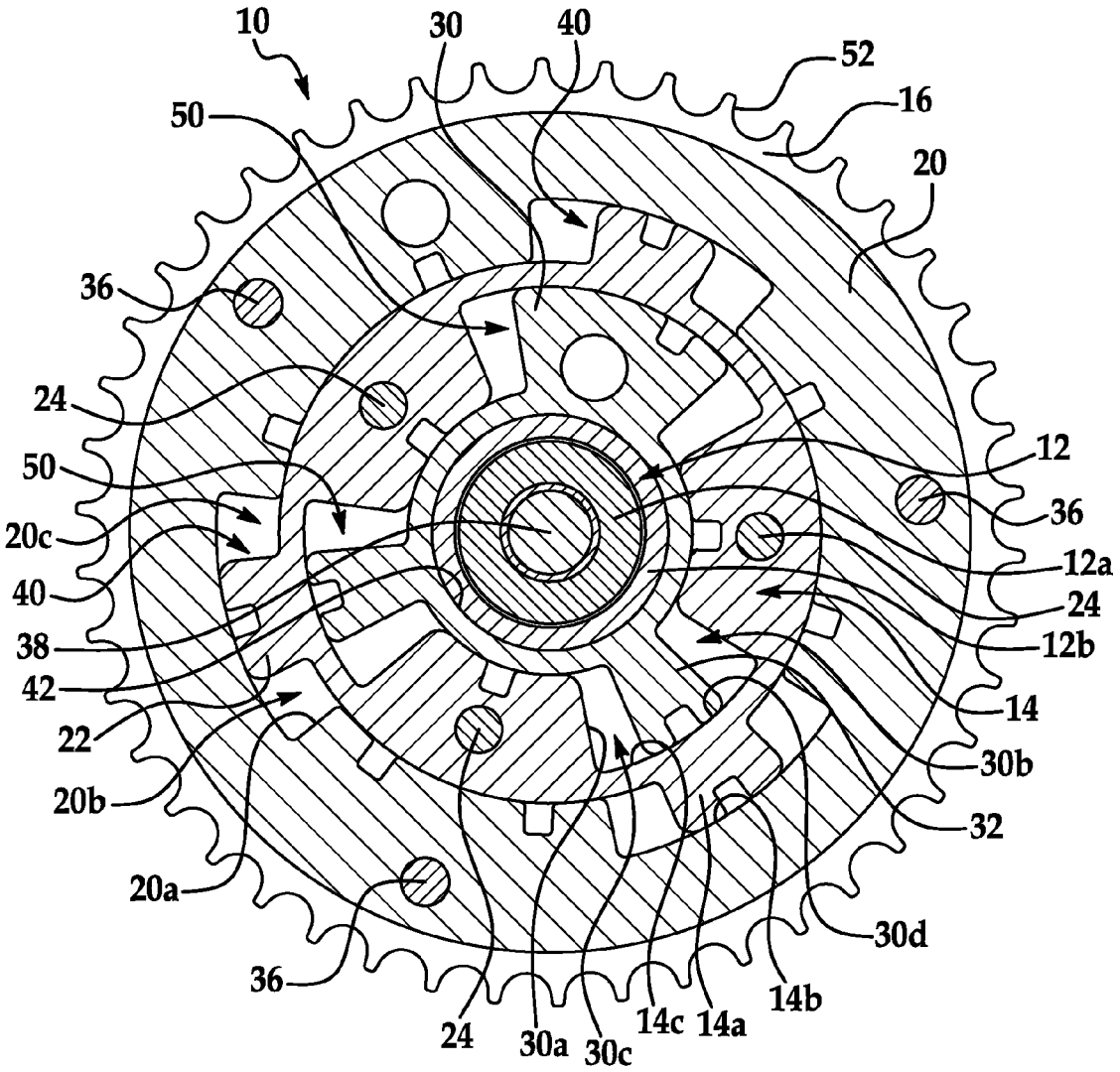
FIG. 1 is a cross sectional view taken transverse to an axis of rotation of a dual variable cam timing phaser for an internal combustion engine having a concentric camshaft according to the present invention.
Figure 2:
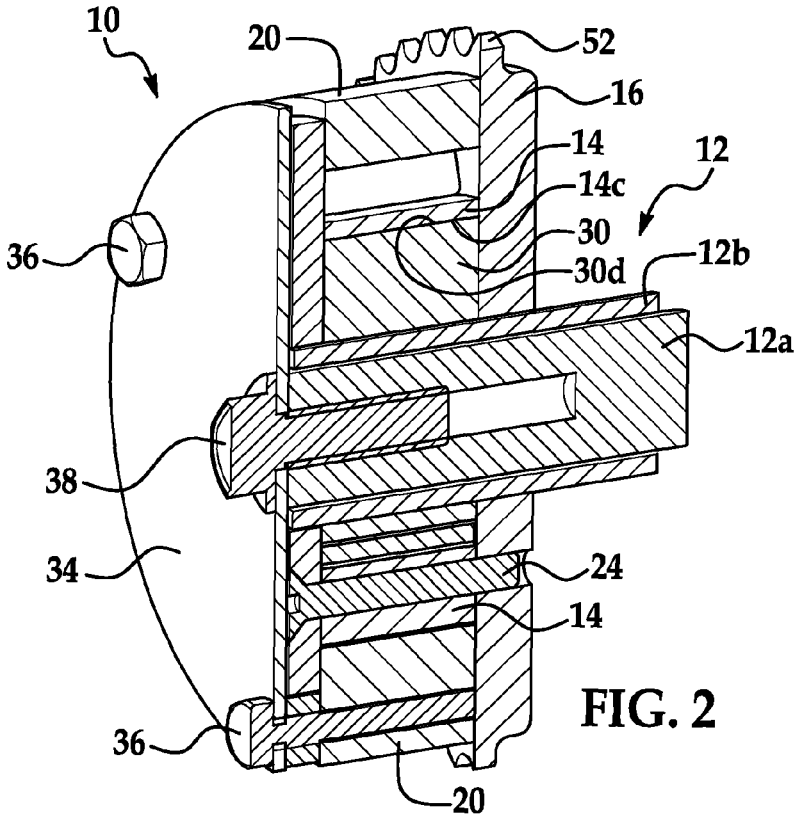
FIG. 2 is a cross sectional view taken along an axis of rotation of the dual variable cam timing phaser of FIG. 1.
Figure 3:
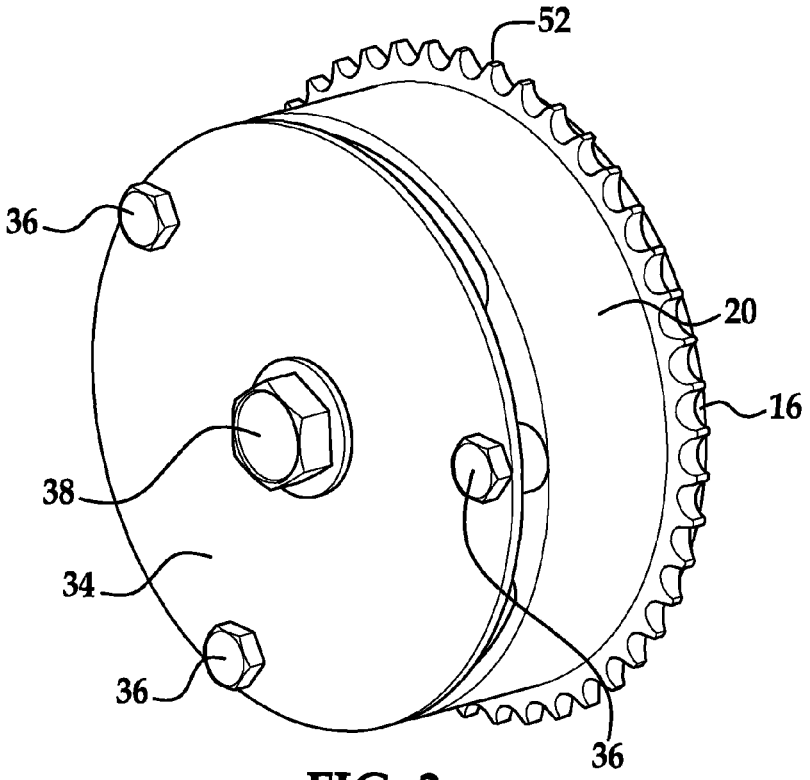
FIG. 3 is a perspective end view of the dual variable cam timing phaser of FIGS. 1-2.

Referring now to FIGS. 1-3, a dual variable cam timing phaser 10 can be driven by power transferred from an engine crankshaft (not shown) to be delivered to a concentric camshaft 12 for manipulating two sets of cams (not shown). A portion of a variable cam timing (VCT) phaser assembly 10 is illustrated including the concentric camshaft 12 having an inner shaft 12*a* and an outer shaft 12*b*. Primary rotary motion can be transferred to the concentric camshaft 12 through the sprocket ring 52 of annular flange 16 operably associated with drive stator 14. Secondary rotary motion, or phased relative rotary motion between inner camshaft 12*a* and outer camshaft 12*b*, can be provided by the dual variable cam timing phaser 10. The phaser 10 can include the drive stator 14 to be connected by an endless loop, flexible, power transmission member for rotation with the engine crankshaft. Two concentric driven rotors 20, 30 can be associated with the stator 14. Each rotor 20, 30 can be connected for rotation with a respective one shaft 12*a*, 12*b* of the concentric camshaft 12 supporting the corresponding two sets of cams. The drive stator 14 and the driven rotors 20, 30 are all mounted for rotation about a common axis. A plurality of radially stacked, vane-type hydraulic couplings 40, 50 for coupling the driven rotors 20, 30 for rotation with the drive stator 14 enable the phase of the driven rotors 20, 30 to be adjusted independently of one another relative to the drive stator 14.

The plurality of radially stacked, vane-type hydraulic couplings can include a radially outer located vane-type hydraulic coupling 40 and a radially inner located vane-type hydraulic coupling 50. The radially outer located vane-type hydraulic coupling 40 can include at least one radially outer located vane 22 and at least one corresponding radially outer located cavity 20*a* associated with the radially outer located rotor 20 to be divided by the at least one radially outer located vane 22 into a first outer variable volume working chamber 20*b* and a second outer variable volume working chamber 20*c*. The radially inner located vane-type hydraulic coupling 50 can include at least one radially inner located vane 32 and at least one corresponding radially inner located cavity 30*a* adjacent the radially inner located rotor 30 to be divided by the at least one radially inner located vane 32 into a first inner variable volume working chamber 30*b* and a second inner variable volume working chamber 30*c*.

The radially outer located vane-type hydraulic coupling 40 can include a combination of an outer vane 22 and cavity 20*a* associated with the outer rotor 20 to define first and second outer variable volume working chambers 20*b*, 20*c*. The combination of the outer vane 22 and cavity 20*a* can be defined by the stator 14 having a wall portion 14*a* with a radially outer surface 14*b* defining the outer vane 22, and the outer rotor 20 surrounding the radially outer surface 14*b* of the stator 14 to define the outer cavity 20*a*. The radially inner located vane-type hydraulic coupling 50 can include a combination of an inner vane 32 and cavity 30*a* associated with the inner rotor 30 to define first and second inner variable volume working chambers 30*b*, 30*c*. The combination of the inner vane 32 and cavity 30*a* can be defined by the stator 14 having a wall 14*a* with a radially inner surface 14*c* defining the inner cavity 30*a*, and the inner rotor 30 having an outer surface 30*d* defining the inner vane 32.

As best seen in FIGS. 1 and 2, the drive stator 14 is connected to the annular flange 16 and associated sprocket ring 52 through fasteners 24. Outer rotor 20 is connected to inner concentric camshaft 12*a* through end plate 34, outer fasteners 36 and central fastener 38. Inner rotor 30 is directly connected to an outer surface 42 of outer concentric camshaft 12*b*.

In operation, a dual variable cam timing phaser 10 provides radially outer annular spaces or cavities 20*a* and radially inner annular spaces or cavities 30*a* with respect to the drive stator 14 and the concentrically located driven outer and inner rotors 20, 30. The annular spaces or cavities 20*a*, 30*a* are divided into segment-shaped or arcuate variable volume working chambers 20*b*, 20*c*, 30*b*, 30*c* by outer and inner vanes 22, 32 extending radially from a surface of the outer and inner rotors 20, 30 and one or more vanes or walls 18 extending radially from a surface of the drive stator 14. As hydraulic fluid is admitted into and expelled from the various chambers 20*b*, 20*c*, 30*b*, 30*c*, the vanes 22, 32 rotate relative to one another and thereby vary the relative angular position of the driven outer and inner rotors 20, 30 with respect to each other and with respect to the stator 14.

Figure 4:
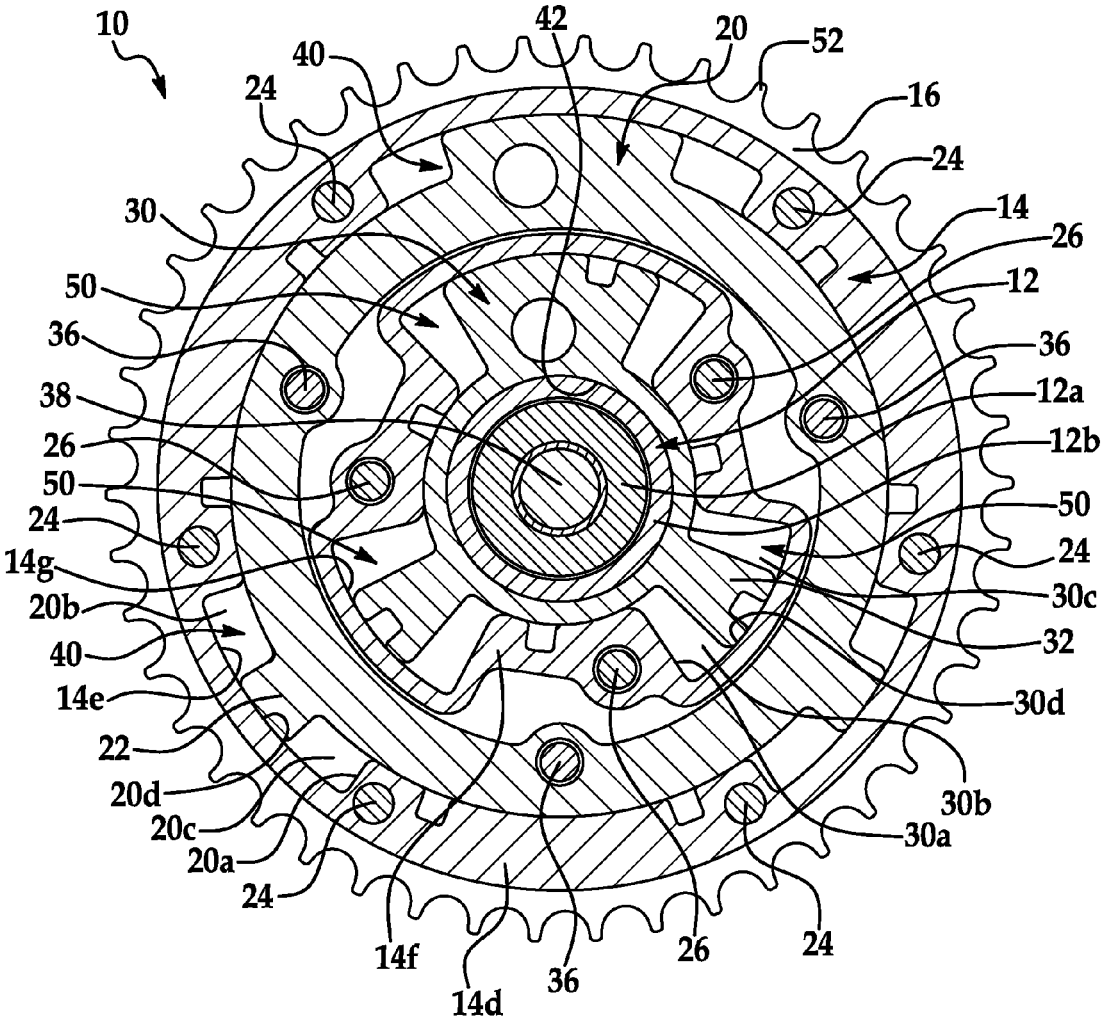
FIG. 4 is a cross sectional view taken transverse to an axis of rotation of a dual variable cam timing phaser for an internal combustion engine having a concentric camshaft according to another configuration of the present invention.
Figure 5:
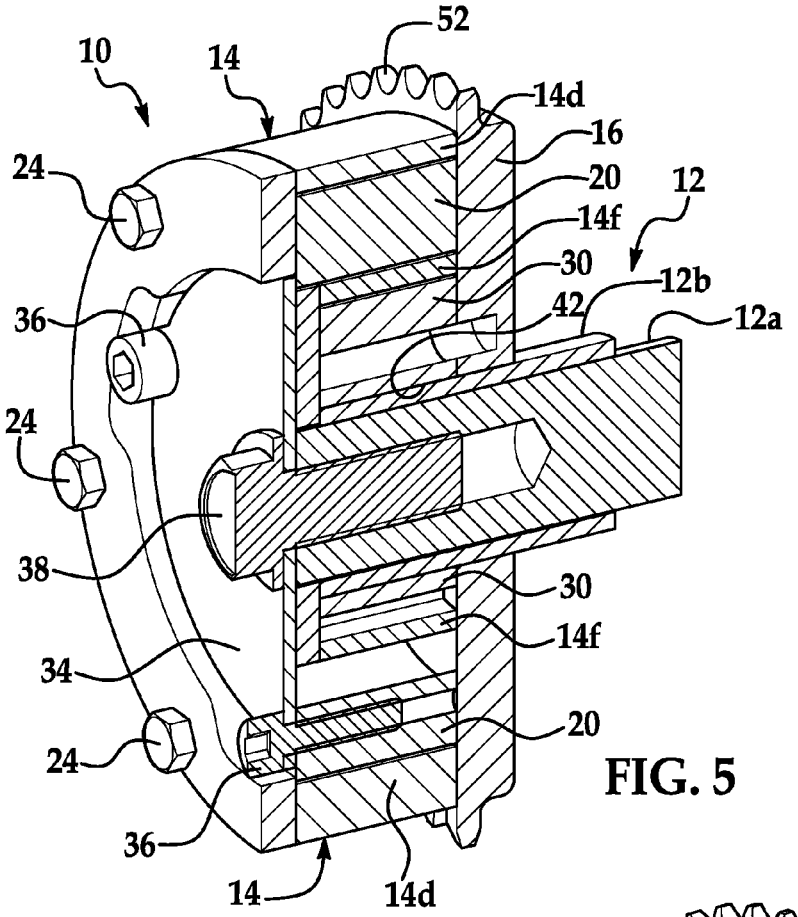
FIG. 5 is a cross sectional view taken along an axis of rotation of the dual variable cam timing phaser of FIG. 4.
Figure 6:
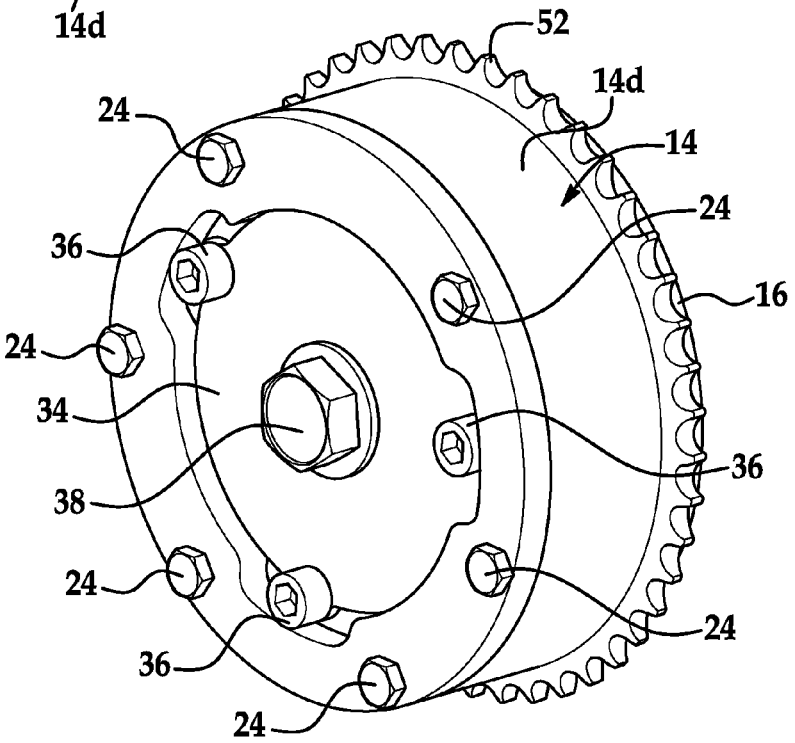
FIG. 6 is a perspective end view of the dual variable cam timing phaser of FIGS. 4-5.

Referring now to FIGS. 4-6, and as previously described with respect to FIGS. 1-3, a dual variable cam timing phaser 10 can be driven by power transferred from an engine crankshaft (not shown) to be delivered to a concentric camshaft 12 for manipulating two sets of cams (not shown). A portion of a variable cam timing (VCT) phaser assembly 10 is illustrated including the concentric camshaft 12 having an inner camshaft 12*a* and an outer camshaft 12*b*. Primary rotary motion can be transferred to the concentric camshaft 12 through the assembly of sprocket ring 52 to annular flange 16 operably associated with drive stator 14. Secondary rotary motion, or phased relative rotary motion between inner camshaft 12*a* and outer camshaft 12*b*, can be provided by the dual variable cam timing phaser 10. The phaser 10 can include the drive stator 14 to be connected for rotation with the engine crankshaft. Two concentric driven rotors 20, 30 can be associated with the stator 14. Each rotor 20, 30 can be connected for rotation with a respective one of the concentric camshafts 12 supporting the corresponding two sets of cams. The drive stator 14 and the driven rotors 20, 30 are all mounted for rotation about a common axis. A plurality of radially stacked, vane-type hydraulic couplings 40, 50 for coupling the driven rotors 20, 30 for rotation with the drive stator 14 enable the phase of the driven rotors 20, 30 to be adjusted independently of one another relative to the drive stator 14. In this configuration, the stator 14 includes a radially outer wall portion 14*d*, and a radially inner wall portion 14*f*.

The plurality of radially stacked, vane-type hydraulic couplings can include a radially outer located vane-type hydraulic coupling 40 and a radially inner located vane-type hydraulic coupling 50. The radially outer located vane-type hydraulic coupling 40 can include at least one radially outer located vane 22 and at least one corresponding radially outer located cavity 20*a* associated with the radially outer located rotor 20 to be divided by the at least one radially outer located vane 22 into a first outer variable volume working chamber 20*b* and a second outer variable volume working chamber 20*c*. The radially inner located vane-type hydraulic coupling 50 can include at least one radially inner located vane 32 and at least one corresponding radially inner located cavity 30*a* adjacent the radially inner located rotor 30 to be divided by the at least one radially inner located vane 32 into a first inner variable volume working chamber 30*b* and a second inner variable volume working chamber 30*c*.

The radially outer located vane-type hydraulic coupling 40 can include a combination of an outer vane 22 and cavity 20*a* associated with the outer rotor 20 to define first and second outer variable volume working chambers 20*b*, 20*c*. The combination of the outer vane 22 and cavity 20*a* can be defined by the stator 14 having a radially outer wall portion 14*d* with an inner surface 14*e* defining the outer cavity 20*a*, and the outer rotor 20 having an outer surface 20*d* defining the outer vane 22. The radially inner located vane-type hydraulic coupling 50 can include a combination of an inner vane 32 and cavity 30*a* associated with the inner rotor 30 to define first and second inner variable volume working chambers 30*b*, 30*c*. The combination of the inner vane 32 and cavity 30*a* can be defined by the stator 14 having a radially inner wall portion 14*f* interposed radially between the outer rotor 20 and the inner rotor 30. The inner wall portion 14*f* can have a radially inner surface 14*g* defining the inner cavity 30*a*, and the inner rotor 30 can have an outer surface 30*d* defining the inner vane 32.

As best seen in FIGS. 4-5, the outer wall portion 14*d* of drive stator 14 is connected to the flange 16 and associated sprocket ring 52 through fasteners 24. Outer rotor 20 is connected to inner concentric camshaft 12*a* through end plate 34, outer fasteners 36, and central fastener 38. The inner wall portion 14*f* of drive stator 14 is connected to the flange 16 and associated sprocket ring 52 through fasteners 26. The inner rotor 30 is connected directly to an outer surface 42 of the outer concentric camshaft 12*b*.

In operation, a dual variable cam timing phaser assembly provides radially outer annular spaces or cavities 20*a* and radially inner annular spaces or cavities 30*a* with respect to the drive stator 14 and the concentrically located driven outer and inner rotors 20, 30. The annular spaces or cavities 20*a*, 30*a* are divided into segment-shaped or arcuate variable volume working chambers 20*b*, 20*c*, 30*b*, 30*c* by outer and inner vanes 22, 32 extending radially from a surface of the outer and inner rotors 20, 30 and one or more vanes or walls 18 extending radially from a surface of the drive stator 14. As hydraulic fluid is admitted into and expelled from the various chambers 20*b*, 20*c*, 30*b*, 30*c*, the vanes 22, 32 rotate relative to one another and thereby vary the relative angular position of the driven outer and inner rotors 20, 30 with respect to each other and with respect to the stator 14.

Figure 7:
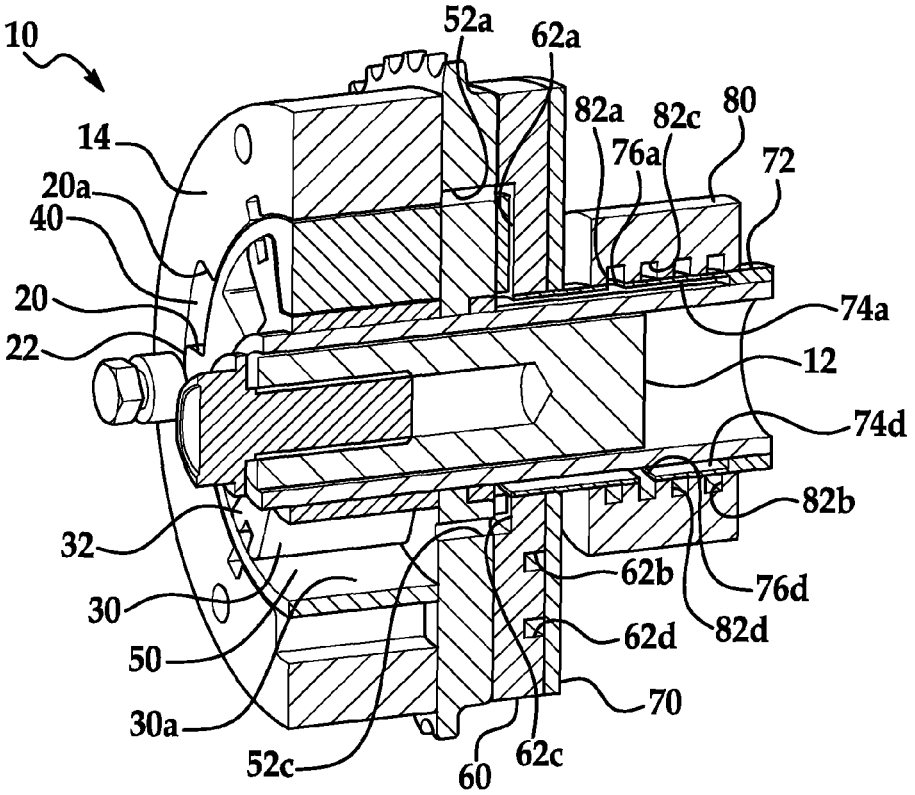
FIG. 7 is a cross sectional view taken along an axis of rotation of a cam phaser illustrating oil passages through the cam phaser for communication with variable volume working chambers.

Referring now to FIGS. 1 and 7-10, a pressurized fluid distribution system for a variable cam timing phaser 10 for an internal combustion engine having at least one camshaft 12 can include a stator 14 having an axis of rotation and at least one rotor 20, 30 rotatable relative to the axis of rotation of the stator 14 independently of the stator 14. At least one vane-type hydraulic coupling 40, 50 can include a combination of a vane 22, 32 and cavity 20*a*, 30*a* associated with the at least one rotor 20, 30 to define first and second variable volume working chambers 20*b*, 20*c*; 30*b*, 30*c*. The first and second variable volume working chambers 20*b*, 20*c*; 30*b*, 30*c*, when selectively communicating with a source of pressurized fluid, can facilitate angular phase orientation of the at least one rotor 20, 30 independently with respect to the stator 14. At least one fluid transfer plate 60 can include a plurality of pressurized fluid passages 62*a*, 62*b*, 62*c*, 62*d*. Each fluid passage 62*a*, 62*b*, 62*c*, 62*d* can extend from a corresponding centrally located port 64*a*, 64*b*, 64*c*, 64*d* in fluid communication with a radially extending passage portion 66*a*, 66*b*, 66*c*, 66*d* in fluid communication with an arcuately extending passage portion 68*a*, 68*b*, 68*c*, 68*d*. At least one pressurized fluid passage 62*a*, 62*b*, 62*c*, 62*d* can be located on each side 60*a*, 60*b* of the at least one fluid transfer plate 60 for communication with a corresponding one of the first and second variable volume working chambers 20*b*, 20*c*, 30*b*, 30*c*. As best seen in FIG. 7, the arcuate fluid passage portions 68*a*, 68*b*, 68*c*, 68*d* are in fluid communication with corresponding longitudinally extending fluid passages 52*a*, 52*c* (only two of which are shown) extending through the sprocket ring 52. Some of the longitudinally extending fluid passages 52*b*, 52*d* extend through the sprocket ring 52 (not shown in FIG. 7) and also extend through the at least one fluid passage plate 60, as best seen in FIG. 9A. The longitudinally extending fluid passages 52*a*, 52*b*, 52*c*, 52*c* provide fluid communication between the corresponding first and second variable volume working chambers 20*b*, 20*c*, 30*b*, 30*c* and the fluid passages 62*a*, 62*b*, 62*c*, 62*d*.

Figure 8:
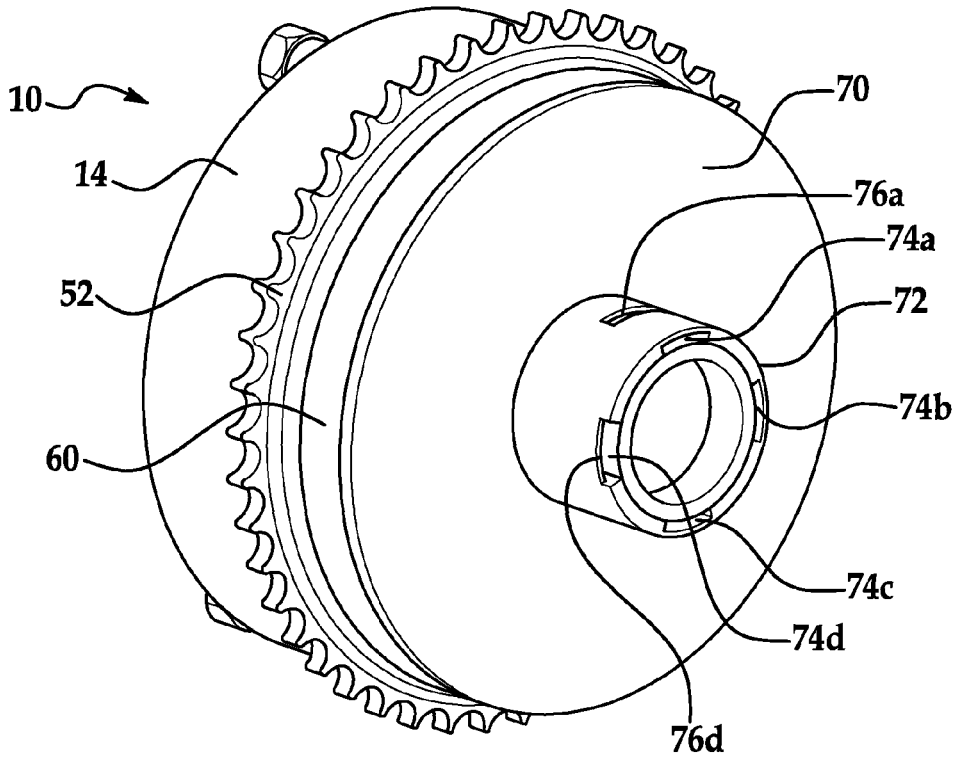
FIG. 8 is a perspective view illustrating oil passages through an oil transfer sleeve of a camshaft for communication with variable volume working chambers.
Figure 9A:
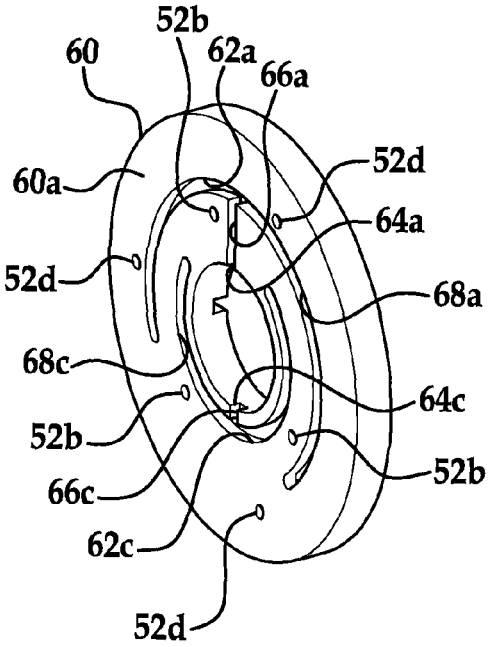
FIGS. 9A and 9B are perspective views of opposite sides of an oil transfer plate illustrating oil passages for communication with variable volume working chambers.
Figure 9B:
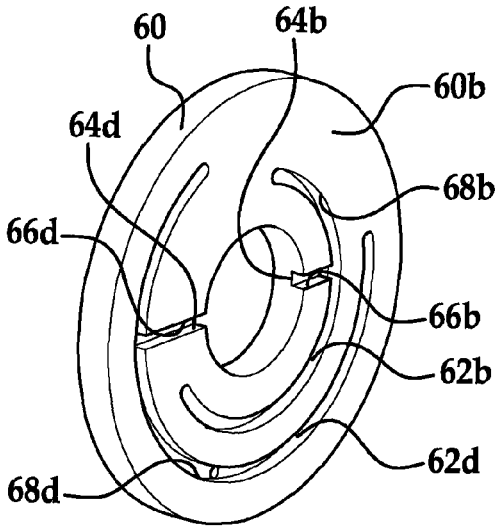

As best seen in FIGS. 7 and 8, a sprocket ring 52 can be interposed between the at least one fluid transfer plate 60 and the first and second variable volume working chambers 20*b*, 20*c*; 30*b*, 30*c*. The sprocket ring 52 can include fluid passages 52*a*, 52*b*, 52*c*, 52*d* formed therethrough allowing fluid communication between the plurality of fluid passages 62*a*, 62*b*, 62*c*, 62*d* of the at least one fluid transfer plate 60 and the first and second variable volume working chambers 20*b*, 20*c*; 30*b*, 30*c*. An end plate 70 can be assembled to the at least one fluid transfer plate 60 sealing at least some of the pressurized fluid passages 62*a*, 62*b*, 62*c*, 62*d* on one side 60*a*, 60*b* of the at least one fluid transfer plate 60.

Figure 10:
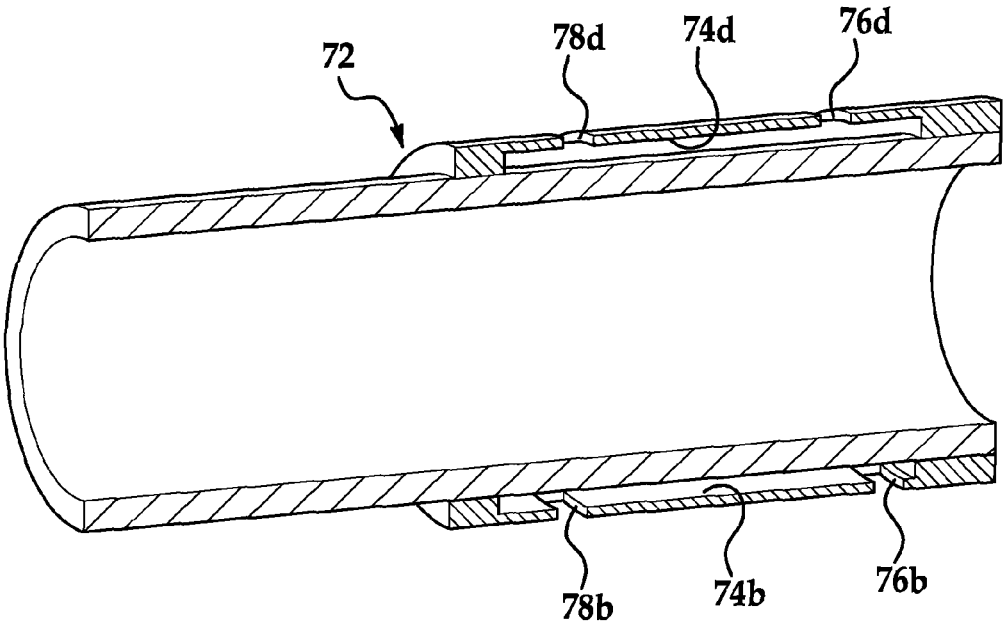
FIG. 10 is a cross sectional view taken along an axis of rotation of a cam phaser illustrating oil passages through an oil transfer sleeve of a camshaft for communication with variable volume working chambers.

As best seen in FIGS. 7, 8 and 10, a fluid transfer sleeve 72 can include a plurality of longitudinally extending and circumferentially spaced fluid passages 74*a*, 74*b*, 74*c*, 74*d* in fluid communication with longitudinally spaced and circumferentially spaced fluid ports 76*a*, 76*b*, 76*c*, 76*d* at one end and corresponding fluid ports 78*a*, 78*b*, 78*c*, 78*d* at an opposite end. Each fluid port 76*a*, 76*b*, 76*c*, 76*d* defining separate and independent corresponding fluid passages 74*a*, 74*b*, 74*c*, 74*d* separate from the other fluid ports 76*a*, 76*b*, 76*c*, 76*d* of the fluid transfer sleeve 72. Each fluid port 78*a*, 78*b*, 78*c*, 78*d* defining separate and independent fluid passages 74*a*, 74*b*, 74*c*, 74*d* from other fluid outlet ports 78*a*, 78*b*, 78*c*, 78*d* of the fluid transfer sleeve 72. Each fluid port 78*a*, 78*b*, 78*c*, 78*d* can be in fluid communication with a corresponding pressurized fluid passage 62*a*, 62*b*, 62*c*, 62*d* of the at least one fluid transfer plate 60. The separate fluid passages 74*a*, 74*b*, 74*c*, 74*d* allow independent control of the corresponding fluidly connected variable volume working chamber 20*b*, 20*c*; 30*b*, 30*c*.

As best seen in FIGS. 7 and 10, a cam bearing 80 can be engageable with the fluid transfer sleeve 72. The cam bearing 80 can having a plurality of annular fluid passages 82*a*, 82*b*, 82*c*, 82*d* spaced longitudinally from one another. Each annular fluid passage 82*a*, 82*b*, 82*c*, 82*d* can be in fluid communication with one corresponding fluid passage 74*a*, 74*b*, 74*c*, 74*d* of the fluid transfer sleeve 72.

Figure 11:
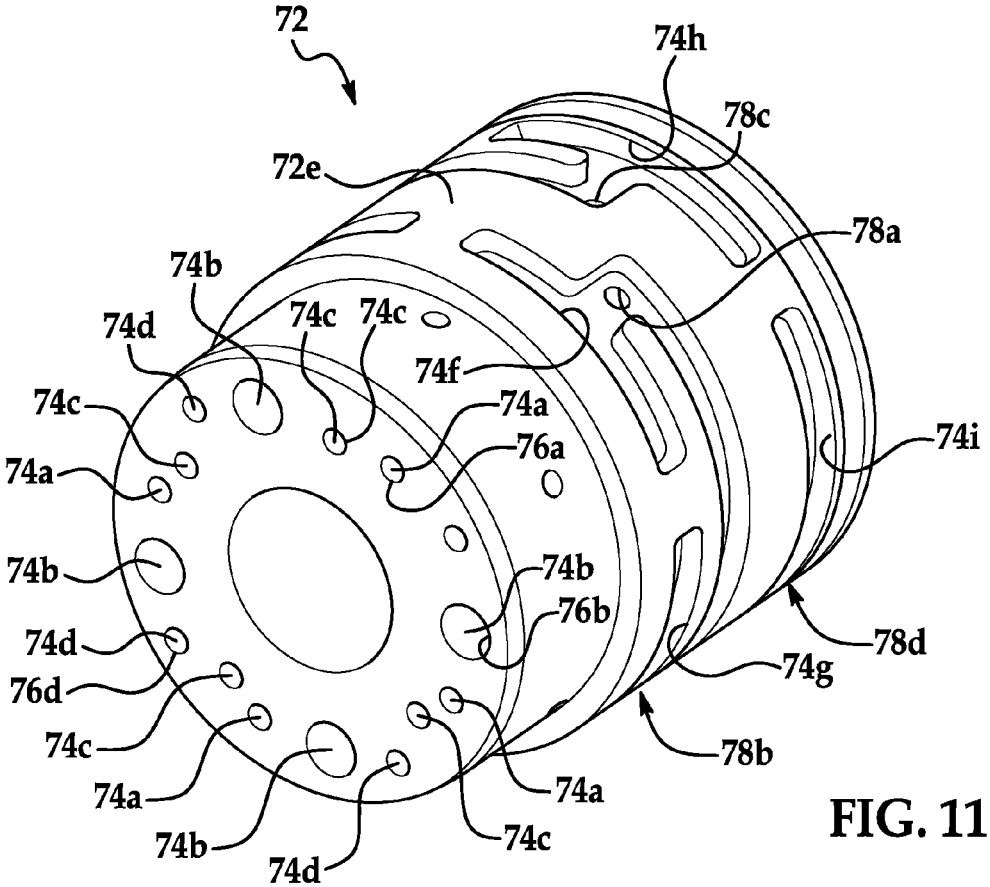
FIG. 11 is a perspective view of a fluid transfer sleeve having a plurality of fluid passages, extending either externally along a peripheral surface or internally through the sleeve or both, for communication pressurized fluid from a fluid source to a phaser or dual phaser.
Figure 12:
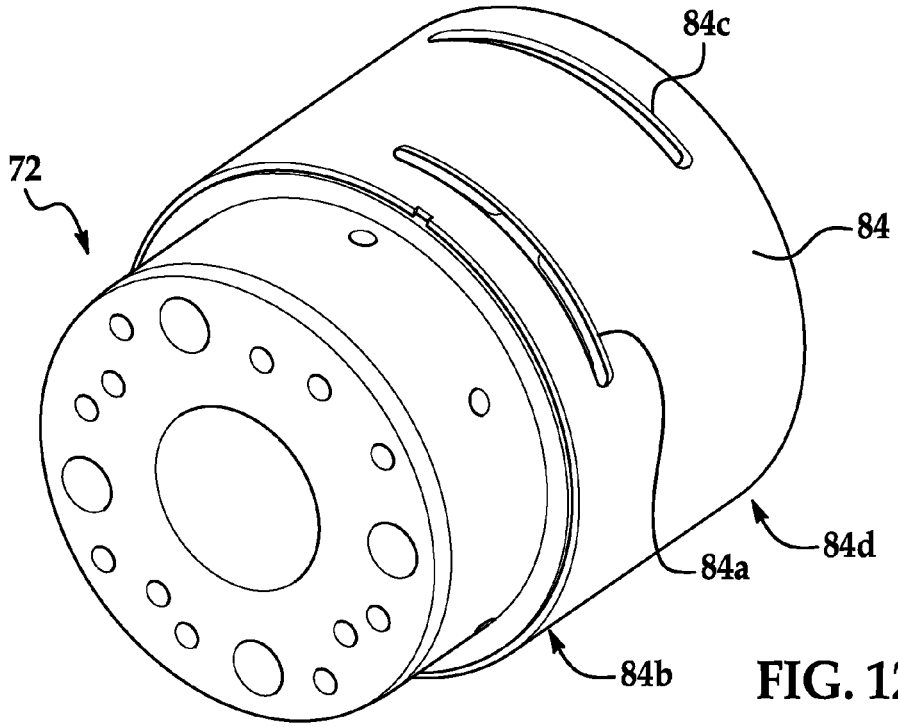
FIG. 12 is a perspective view of the fluid transfer sleeve of FIG. 11 operably engaged with a fluid passage cylinder, or cam bearing, having a plurality of fluid passage ports extending therethrough into fluid communication with the plurality of fluid passages formed in the fluid transfer sleeve.

Referring now to FIG. 11, a construction of the fluid transfer sleeve 72 can include a plurality of circumferentially spaced annular groove segment portions 74*f*, 74*g*, 74*h*, 74*i* of the corresponding fluid passages 74*a*, 74*b*, 74*c*, 74*d* in fluid communication with fluid ports 76*a*, 76*b*, 76*c*, 76*d* and fluid ports 78*a*, 78*b*, 78*c*, 78*d*. Each fluid passage 74*a*, 74*b*, 74*c*, 74*d* can be separate and independent of the other fluid passage 74*a*, 74*b*, 74*c*, 74*d* of the fluid transfer sleeve 72. Each fluid port 78*a*, 78*b*, 78*c*, 78*d* can be in fluid communication with a corresponding pressurized fluid passage 62*a*, 62*b*, 62*c*, 62*d* of the at least one fluid transfer plate 60, if desired. The separate annular groove segment portions 74*f*, 74*g*, 74*h*, 74*i* allow independent control of the corresponding fluidly connected variable volume working chamber 20*b*, 20*c*; 30*b*, 30*c*. As best seen in FIG. 12, a fluid passage cylinder 84 can be assembled to the fluid transfer sleeve 72 sealing at least a portion of the circumferentially spaced, annular groove fluid passage portions 74*f*, 74*g*, 74*h*, 74*i* of the plurality of pressurized fluid passages 74*a*, 74*b*, 74*c*, 74*d* formed on an exterior peripheral surface 72*e* of the fluid transfer sleeve 72. The fluid passage cylinder 84 can include slots defining fluid ports 84*a*, 84*b*, 84*c*, 84*d*.

Figure 13:
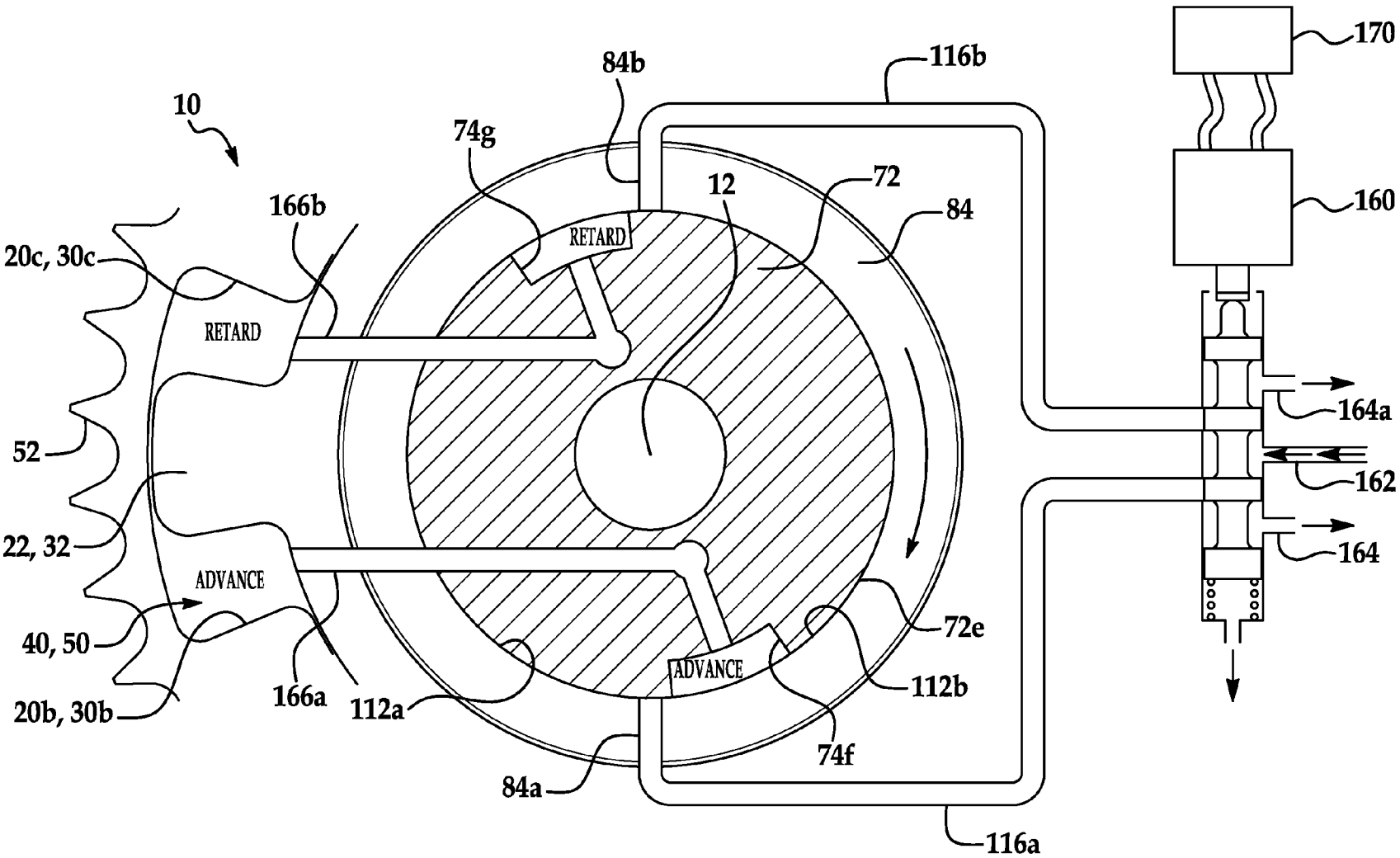
FIG. 13 is a simplified schematic view illustrating groove segments in fluid communication with variable volume working chambers for advance and retard movement of a rotor relative to a stator with the control valve shown in a null spool position.

Referring now to the simplified schematic of FIG. 13, a variable cam timing phaser 10 can include a fluid transfer sleeve 72 and first and second common shared fluid passages 116*a*, 116*b* in fluid communication with one of the first and second vane-type hydraulic couplings 40, 50 with variable volume working chambers 20*b* 20*c*; 30*b*, 30*c* through corresponding first and second fluid passages 166*a*, 166*b*, and an additional port, inlet or outlet, for the control valve 160. By way of example and not limitation, FIG. 13 illustrates an additional outlet port 164*a* for purposes of describing the operation of the variable cam timing phaser 10. However, it should be recognized that the inlet port 162 and outlet ports 164, 164*a* can be reversed to provide the opposite function from that described hereinafter. By way of example and not limitation, as illustrated in FIG. 13, when the control valve 160 is shifted in one direction allowing fluid communication from the inlet port 162 to one of the variable volume working chamber 20*b*, 30*b* through first common shared fluid passage 116*a*, annular groove segment 74*f*, and first fluid flow passage 166*a*, while simultaneously allowing fluid communication from the outlet port 164 to the other of the variable volume working chamber 20*c*, 30*c* through second common shared fluid passage 116*b*, annular groove segment 74*g*, and second fluid flow passage 166*b*. The control valve can be shifted to another position allowing fluid communication from the outlet port 164*a* to the first common shared fluid passage 116*a*, while simultaneously allowing fluid communication from the inlet port 162 to the second common shared fluid passage 116*b*. The fluid transfer sleeve 72 fixedly associated with camshaft 12 rotates with the camshaft 12 clockwise to isolate the first and second vane-type hydraulic couplings 40, 50 from the first and second common shared fluid passages 116*a*, 116*b* with outer diameter lands 112*a*, 112*b* during a angular portion of the rotation of shaft 12. It should be recognized that the angular extent of the groove segments 74*f*, 74*g* and the angular extent of the outer diameter lands 112*a*, 112*b* can be any desired non-overlapping angular degree of coverage. By way of example and not limitation, as the fluid transfer sleeve 72 fixedly associated with the camshaft 12 can rotate further in the clockwise direction, such that the outlet port 164*a* is brought into fluid communication with the other variable volume working chamber 20*c*, 30*c* through the first common shared fluid passage 116*a*, the annular groove segment 74*g*, and the second fluid passage portion 166*b*, while simultaneously the inlet port 162 is brought into fluid communication with the one variable volume working chamber 20*b*, 30*b* through the second common shared fluid passage 116*b*, the annular groove segment 74*f*, and the first fluid passage portion 166*a*. It should be recognized that the control valve 160 can be in either of the shifted longitudinal end positions or in a null position (as shown), while the fluid transfer sleeve and concentric camshaft 12 can be rotated through an appropriate angular orientation to allow fluid communication between the first and second common shared fluid flow passage 116*a*, 116*b* and the first and second fluid passage portions 166*a*, 166*b* through corresponding groove segments 74*f*, 74*g* to communicate with the corresponding first and second vane-type hydraulic couplings 40, 50.

The annular groove segments 74*f*, 74*g* can be angularly positioned to benefit from oscillating torque. Phaser control can be accomplished by moving the control valve 160 away from a central null position to one of the shifted longitudinal end positions, while the annular groove segments 74*f*, 74*g* align with the first and/or second common shared fluid passages 116, 116*b* and move back to the central null position to close off flow until the desired alignment repeats. The control valve 160 can move back away from the central null position to continue phaser motion when the desired alignment repeats. Alternatively, the control valve 160 can be oscillated in both directions from the central null position during one revolution of concentric camshaft 12. An alternative control strategy for shared oil feed phasers can include oscillation of the control valve 160 around a null position at the camshaft rotation frequency or at fractional multiples of camshaft rotation frequency. The engine control unit can advance or retard the timing of the control valve 160 motion to overlap more or less with the portion of the cam rotation where annular groove segments 74*f*, 74*g* allow fluid flow in or out of the connected vane-type hydraulic couplings 40, 50. In other words, the control valve 160 is not held at a null position; instead flow from the control valve to the phaser is opened or closed by varying the overlap of the control valve 160 opening of the inlet ports 162 and/or outlet ports 164, 164*a* and the annular groove segment 74*f*, 74*g* openings being in fluid communication with a common shared fluid passage 116*a*, 116*b*.

It should be recognized that the annular groove segments 74*f*, 74*g* and outer diameter lands 112*a*, 112*b* can be equally angularly spaced as illustrated, or can be positioned an any non-overlapping angular extent and orientation desired. When the annular groove segments 74*f*, 74*g* and lands 112*a*, 112*b* are equally angularly spaced, the first and second variable volume working chambers 20*b*, 20*c*; 30*b*, 30*c* are simultaneously in fluid communication or simultaneously isolated depending on the angular position of the fluid transfer sleeve 72 and associated cam bearing 80. When the segments 74*f*, 74*g* and lands 112*a*, 112*b* are not equally angularly spaced, the fluid communication and isolation of the first and second variable volume working chambers 20*b*, 20*c*; 30*b*, 30*c* are offset in time with respect to one another depending on the angular position of the fluid transfer sleeve 72 and associated cam bearing 80.

While only two annular groove segments 74*f*, 74*g* have been shown schematically in FIG. 13 to simplify the illustration and explanation of the operation of the fluid transfer sleeve 72, it should be recognized that any number of annular groove segments 74*f*, 74*g*, 74*h*, 74*i* can be located within a common rotational plane, subject to size restrictions, and that additional annular groove segments can be placed in parallel, longitudinally spaced, rotational planes to increase the overall number of common shared fluid passages 116*a*, 116*b* capable of being controlled by a control valve 160. The angular orientation and/or overlap of the annular groove segments 74*f*, 74*g* between parallel, longitudinally spaced, rotational planes can be adjusted as desired to achieve the desired operating characteristics. The control valve 160 can include additional fluid inlet and exhaust ports, and/or a plurality of control valves 160 can be provided. By way of example and not limitation, one control valve 160 can be provided for each parallel, longitudinally spaced, rotational planes containing annular groove segments to be brought into fluid communication with common shared fluid passages 116*a*, 116*b*, and/or a control valve 160 can be connected to a plurality of parallel, longitudinally spaced, rotational planes containing annular groove segments 112*a*, 112*b* for control purposes, if desired.

A method of assembling a pressurized fluid distribution system for a variable cam timing phaser 10 of an internal combustion engine having at least one camshaft 12 is disclosed. The method can include providing a stator 14 having an axis of rotation, and assembling at least one rotor 20, 30 within the stator 14 to be rotatable relative to the axis of rotation of the stator 14 independently of the stator 14. The stator 14 and at least one rotor 20, 30 define at least one vane-type hydraulic coupling 40, 50 including a combination of a vane 22, 32 and cavity 20*a*, 30*a* associated with the at least one rotor 20, 30 to define first and second variable volume working chambers 20*b*, 20*c*; 30*b*, 30*c*. The first and second variable volume working chambers 20*b*, 20*c*; 30*b*, 30*c*, when selectively communicating with a source of pressurized fluid, facilitate angular phase orientation of the at least one rotor 20, 30 independently with respect to the stator 14. The method can further include assembling at least one fluid transfer plate 60 having a plurality of pressurized fluid passages 62*a*, 62*b*, 62*c*, 62*d* with respect to the first and second variable volume working chambers 20*b*, 20*c*; 30*b*. 30*c*. Each passage 62*a*, 62*b*, 62*c*, 62*d* can extend from a corresponding centrally located port 64*a*, 64*b*, 64*c*, 64*c*, 64*d* in fluid communication with a radially extending passage portion 66*a*, 66*b*, 66*c*, 66*d* in fluid communication with an arcuately extending passage portion 68*a*, 68*b*, 68*c*, 68*d*. At least one pressurized fluid passage 62*a*, 62*b*, 62*c*, 62*d* can be formed on each side 60*a*, 60*b* of the at least one fluid transfer plate 60 for communication with a corresponding one of the first and second variable volume working chambers 20*b*, 20*c*; 30*b*, 30*c*.

A sprocket ring 52 can be assembled to the stator 14 interposed between the at least one fluid passage plate 60 and the first and second variable volume working chambers 20*b*, 20*c*; 30*b*, 30*c*. The sprocket ring 52 can include fluid passages 52*a*, 52*b*, 52*c*, 52*d* formed therethrough allowing fluid communication between the plurality of fluid passages 62*a*, 62*b*, 62*c*, 62*d* of the at least one fluid transfer plate 60 and the first and second variable volume working chambers 20*b*, 20*c*; 30*b*, 30*c*. An end plate 70 can be assembled to the at least one fluid passage plate 60 sealing at least some of the pressurized fluid passages 62*a*, 62*b*, 62*c*, 62*d* on one side 60*a*, 60*b* of the at least one fluid transfer plate 60.

A fluid transfer sleeve 72 can be assembled over the at least one camshaft 12. The fluid transfer sleeve 72 can be formed with a plurality of longitudinally extending and circumferentially spaced fluid passages 74*a*, 74*b*, 74*c*, 74*d* in fluid communication with longitudinally spaced and circumferentially spaced fluid ports 76*a*, 76*b*, 76*c*, 76*d* and ports 78*a*, 78*b*, 78*c*, 78*d*. Each fluid passage 74*a*, 74*b*, 74*c*, 74*d* can be separate and independent from the other fluid passages 74*a*, 74*b*, 74*c*, 74*d* of the fluid transfer sleeve 72. Each fluid outlet port 78*a*, 78*b*, 78*c*, 78*d* can define separate and independent fluid passages from other fluid outlet ports 78*a*, 78*b*, 78*c*, 78*d* of the fluid transfer sleeve 72 for assembly into fluid communication with a corresponding pressurized fluid passage 62*a*, 62*b*, 62*c*, 62*d* allowing fluid communication with the variable volume working chambers 20*b*, 20*c*; 30*b*, 30*c* of the first and second vane-type hydraulic couplings 40, 50.

A cam bearing 80 can be assembled into engagement with the fluid transfer sleeve 72. The cam bearing 80 can be formed having a plurality of annular fluid passages 82*a*, 82*b*, 82*c*, 82*d* spaced longitudinally from one another. Each annular fluid passage 82*a*, 82*b*, 82*c*, 82*d* can be assembled into fluid communication with one corresponding fluid passage 74*a*, 74*b*, 74*c*, 74*d* of the fluid transfer sleeve 72.

A variable cam timing phaser 10 can be driven by power transferred from an engine crankshaft and delivered to at least one camshaft 12 for manipulating at least one set of cams. The phaser 10 can include a drive stator 14 connectible for rotation with an engine crankshaft. At least one driven rotor 20, 30 can be associated with the stator 14. Each rotor 20, 30 can be connected for rotation with a corresponding one of the at least one camshaft 12 supporting at least one set of cams. The drive stator 14 and the driven rotor 20, 30 can be mounted for rotation about a common axis. A plurality of vane-type hydraulic couplings 40, 50 are defined between the drive stator 14 and driven rotor 20, 30 for coupling the at least one driven rotor 20, 30 for rotation with the drive stator 14 to enable the phase of the at least one driven rotor 20, 30 to be adjusted relative to the drive stator 14. A fluid transfer plate 60 can be provided having a plurality of pressurized fluid passages 62*a*, 62*b*, 62*c*, 62*d*, if desired. Each passage 62*a*, 62*b*, 62*c*, 62*d* can extend from a corresponding centrally located port 64*a*, 64*b*, 64*c*, 64*d* in fluid communication with a radially extending passage portion 66*a*, 66*b*, 66*c*, 66*d* in fluid communication with an arcuately extending passage portion 68*a*, 68*b*, 68*c*, 68*d*. At least one pressurized fluid passage 62*a*, 62*b*, 62*c*, 62*d* can be formed on each side 60*a*, 60*b* of the at least one fluid transfer plate 60 for communication with the plurality of vane-type hydraulic couplings 40, 50.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pressurized fluid distribution system for a variable cam timing phaser (10) for an internal combustion engine having at least one camshaft (12) comprising:

a stator (14) having an axis of rotation;

at least one rotor (20, 30) rotatable relative to the axis of rotation of the stator (14) independently of the stator (14);

at least one vane-type hydraulic coupling (40, 50) including a combination of a vane (22, 32) and cavity (20*a*, 30*a*) associated with the at least one rotor (20, 30) to define first and second variable volume working chambers (20*b*, 20*c*; 30*b*, 30*c*), wherein the first and second variable volume working chambers (20*b*, 20*c*; 30*b*, 30*c*), when selectively communicating with a source of pressurized fluid, facilitate angular phase orientation of the at least one rotor (20, 30) independently with respect to the stator (14); and a fluid transfer assembly including at least one of:

a fluid transfer sleeve (72) connected to the at least one camshaft (12) for rotation therewith and having a plurality of fluid passages (74*a*, 74*b*, 74*c*, 74*d*), each passage (74*a*, 74*b*, 74*c*, 74*d*) extending from a corresponding fluid port (76*a*, 76*b*, 76*c*, 76*d*) in fluid communication with a corresponding circumferentially spaced annular groove segment portion (74*f*, 74*g*, 74*h*, 74*i*) for selective fluid communication with one of the first and second variable volume working chambers (20*b*, 20*c*; 30*b*, 30*c*) depending on an angular orientation of the fluid transfer sleeve during rotation; and a fluid transfer plate (60) having a plurality of pressurized fluid passages (62*a*, 62*b*, 62*c*, 62*d*), each passage (62*a*, 62*b*, 62*c*, 62*d*) extending from a corresponding centrally located port (64*a*, 64*b*, 64*c*, 64*d*) in fluid communication with a radially extending passage portion (66*a*, 66*b*, 66*c*, 66*d*) in fluid communication with an arcuately extending passage portion (68*a*, 68*b*, 68*c*, 68*d*), at least one pressurized fluid passage (62*a*, 62*b*, 62*c*, 62*d*) on each side (60*a*, 60*b*) of the fluid transfer plate (60) for communication with a corresponding one of the first and second variable volume working chambers (20*b*, 20*c*; 30*b*, 30*c*).

2. The pressurized fluid distribution system of claim 1 further comprising:

a sprocket ring (52) having fluid passages (52*a*, 52*b*, 52*c*, 52*d*) formed therethrough allowing fluid communication between the plurality of pressurized fluid passages (74*a*, 74*b*, 74*c*, 74*d*) of the fluid transfer sleeve (72) and the first and second variable volume working chambers (20*b*, 20*c*; 30*b*, 30*c*).

3. The pressurized fluid distribution system of claim 1 further comprising:

a fluid passage cylinder (84) assembled to the fluid transfer sleeve (72) sealing at least a portion of the plurality of pressurized fluid passages (74*a*, 74*b*, 74*c*, 74*d*) formed on an exterior peripheral surface (72*e*) of the fluid transfer sleeve (72).

4. The pressurized fluid distribution system of claim 1 further comprising:

a cam bearing (80) engageable with the fluid transfer sleeve (72), the cam bearing (80) having a plurality of annular fluid passages (82*a*, 82*b*, 82*c*, 82*d*) spaced longitudinally from one another, each annular fluid passage (82*a*, 82*b*, 82*c*, 82*d*) in fluid communication with at least one corresponding fluid passage (74*a*, 74*b*, 74*c*, 74*d*) of the fluid transfer sleeve (72).

5. The pressurized fluid distribution system of claim 1 further comprising:

a sprocket ring (52) interposed between the fluid transfer plate (60) and the first and second variable volume working chambers (20*b*, 20*c*; 30*b*, 30*c*), the sprocket ring (52) having fluid passages (52*a*, 52*b*, 52*c*, 52*d*) formed therethrough allowing fluid communication between the plurality of pressurized fluid passages (62*a*, 62*b*, 62*c*, 62*d*) of the fluid transfer plate (60) and the first and second variable volume working chambers (20*b*, 20*c*; 30*b*, 30*c*).

6. The pressurized fluid distribution system of claim 1 further comprising:

an end plate (70) assembled to the fluid transfer plate (60) sealing at least some of the pressurized fluid passages (62*a*, 62*b*, 62*c*, 62*d*) on one side (60*a*, 60*b*) of the fluid transfer plate (60).

7. A method of assembling a pressurized fluid distribution system for a variable cam timing phaser (10) for an internal combustion engine having at least one camshaft (12) comprising:

providing a stator (14) having an axis of rotation;

assembling at least one rotor (20, 30) within the stator (14) to be rotatable relative to the axis of rotation of the stator (14) independently of the stator (14) and to define at least one vane-type hydraulic coupling (40, 50) including a combination of a vane (22, 32) and cavity (20*a*, 30*a*) associated with the at least one rotor (20, 30) to define first and second variable volume working chambers (20*b*, 20*c*; 30*b*, 30*c*), wherein the first and second variable volume working chambers (20*b*, 20*c*; 30*b*, 30*c*), when selectively communicating with a source of pressurized fluid, facilitate angular phase orientation of the at least one rotor (20, 30) independently with respect to the stator (14); and assembling a fluid transfer assembly including at least one of:

a fluid transfer sleeve (72) with respect to the camshaft (12) for rotation therewith, the fluid transfer sleeve (72) having a plurality of pressurized fluid passages (74*a*, 74*b*, 74*c*, 74*d*) for fluid communication with respect to the first and second variable volume working chambers (20*b*, 20*c*, 30*b*, 30*c*), each passage (74*a*, 74*b*, 74*c*, 74*d*) extending in fluid communication with a corresponding circumferentially spaced annular groove segment portion (74*f*, 74*g*, 74*h*, 74*i*) for selective communication with one of the first and second variable volume working chambers (20*b*, 20*c*; 30*b*, 30*c*) depending on angular orientation of the fluid transfer sleeve (72) during rotation; and a fluid transfer plate (60) having a plurality of pressurized fluid passages (62*a*, 62*b*, 62*c*, 62*d*), each passage (62*a*, 62*b*, 62*c*, 62*d*) extending from a corresponding centrally located port (64*a*, 64*b*, 64*c*, 64*d*) in fluid communication with a radially extending passage portion (66*a*, 66*b*, 66*c*, 66*d*) in fluid communication with an arcuately extending passage portion (68*a*, 68*b*, 68*c*, 68*d*), at least one pressurized fluid passage (62*a*, 62*b*, 62*c*, 62*d*) on each side (60*a*, 60*b*) of the fluid transfer plate (60) for communication with a corresponding one of the first and second variable volume working chambers (20*b*, 20*c*; 30*b*, 30*c*).

8. The method of claim 7 further comprising:

assembling a sprocket ring (52) to the stator (14) having fluid passages (52*a*, 52*b*, 52*c*, 52*d*) formed therethrough allowing fluid communication between the plurality of fluid passages (74*a*, 74*b*, 74*c*, 74*d*) of the fluid transfer sleeve (72) and the first and second variable volume working chambers (20*b*, 20*c*; 30*b*, 30*c*).

9. The method of claim 7 further comprising:

assembling a fluid passage cylinder (84) to the fluid transfer sleeve (72) sealing at least a portion of the circumferentially spaced, annular groove segment portions (74*f*, 74*g*, 74*h*, 74*i*) of the pressurized fluid passages (74*a*, 74*b*, 74*c*, 74*d*) on the fluid transfer sleeve (72).

10. The method of claim 7 further comprising:

assembling a cam bearing (80) engageable with the fluid transfer sleeve (72), the cam bearing (80) having a plurality of annular fluid passages (82*a*, 82*b*, 82*c*, 82*d*) spaced longitudinally from one another, each annular fluid passage (82*a*, 82*b*, 82*c*, 82*d*) in fluid communication with at least one corresponding fluid passage (74*a*, 74*b*, 74*c*, 74*d*) of the fluid transfer sleeve (72).

11. The method of claim 7 further comprising:

assembling a sprocket ring (52) to the stator (14) interposed between the at least one fluid transfer plate (60) and the first and second variable volume working chambers (20*b*, 20*c*; 30*b*, 30*c*), the sprocket ring (52) having fluid passages (52*a*, 52*b*, 52*c*, 52*d*) formed therethrough allowing fluid communication between the plurality of fluid passages (62*a*, 62*b*, 62*c*, 62*d*) of the at least one fluid transfer plate (60) and the first and second variable volume working chambers (20*b*, 20*c*; 30*b*, 30*c*).

12. The method of claim 7 further comprising:

assembling an end plate (70) to the at least one fluid transfer plate (60) sealing at least some of the pressurized fluid passages (62*a*, 62*b*, 62*c*, 62*d*) on one side (60*a*, 60*b*) of the at least one fluid transfer plate (60).

13. In a variable cam timing phaser (10) driven by power transferred from an engine crankshaft and delivered to a concentric camshaft (12) having an inner camshaft (12*a*) and an outer camshaft (12*b*) for manipulating corresponding sets of cams, the phaser including a drive stator (14) connectible for rotation with the engine crankshaft; first and second driven rotors (20, 30) associated with the stator (14), each driven rotor (20, 30) connectible for rotation with a corresponding one of the inner and outer camshafts (12*a*, 12*b*) supporting the corresponding set of cams, wherein the drive stator (14) and the first and second driven rotors (20, 30) are mounted for rotation about a common axis, and first and second vane-type hydraulic couplings (40, 50) for coupling the corresponding first and second driven rotors (20, 30) for rotation with the drive stator (14) and to enable independent phase control of first and second driven rotors (20, 30) relative to the drive stator (14) and relative to each other, the improvement comprising at least one of:

a fluid transfer sleeve (72) mounted for rotation with the camshaft (12) and having a plurality of pressurized fluid passages (74*a*, 74*b*, 74*c*, 74*d*), each passage (74*a*, 74*b*, 74*c*, 74*d*) extending in fluid communication with a corresponding circumferentially spaced annular groove portion (74*f*, 74*g*, 74*h*, 74*i*) for selective communication with the first and second vane-type hydraulic couplings (40, 50) depending on an angular orientation of the fluid transfer sleeve (72) during rotation; and a fluid transfer plate (60) having a plurality of pressurized fluid passages (62*a*, 62*b*, 62*c*, 62*d*), each passage (62*a*, 62*b*, 62*c*, 62*d*) extending from a corresponding centrally located port (64*a*, 64*b*, 64*c*, 64*d*) in fluid communication with a radially extending passage portion (66*a*, 66*b*, 66*c*, 66*d*) in fluid communication with an arcuately extending passage portion (68*a*, 68*b*, 68*c*, 68*d*), at least one pressurized fluid passage (62*a*, 62*b*, 62*c*, 62*d*) on each side (60*a*, 60*b*) of the at least one fluid transfer plate (60) for communication with a corresponding one of the first and second variable volume working chambers (20*b*, 20*c*; 30*b*, 30*c*).

14. The improvement of claim 13, wherein a first set of circumferentially spaced annular groove segment portions (74*f*, 74*g*, 74*h*, 74*i*) of the plurality of pressurized fluid passages (74*a*, 74*b*, 74*c*, 74*d*) are located within a first common rotational plane of the fluid transfer sleeve (72).

15. The improvement of claim 14, wherein a second set of circumferentially spaced annular groove segment portions (74*f*, 74*g*, 74*h*, 74*i*) of the plurality of pressurized fluid passages (74*a*, 74*b*, 74*c*, 74*d*) are located within a second common rotational plane of the fluid transfer sleeve (72) spaced longitudinally from the first common rotational plane.

* * * * *